US007944408B2

(12) United States Patent
Moon

(10) Patent No.: US 7,944,408 B2
(45) **Date of Patent: *May 17, 2011**

(54) PLASMA DISPLAY APPARATUS AND METHOD OF DRIVING THE SAME

(75) Inventor: Seonghak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 711 days.

This patent is subject to a terminal disclaimer.

(21) Appl. No.: 11/958,801

(22) Filed: Dec. 18, 2007

(65) Prior Publication Data

US 2008/0143643 A1 Jun. 19, 2008

(30) Foreign Application Priority Data

Dec. 19, 2006 (KR) ..... 10-2006-0130123

(51) Int. Cl.
*G09G 3/28* (2006.01)

(52) U.S. Cl. ..... 345/63; 345/60

(58) Field of Classification Search ..... 345/60–70; 315/169.1–169.4

See application file for complete search history.

(56) References Cited

U.S. PATENT DOCUMENTS

| | | | | |
|---|---|---|---|---|
| 5,566,064 | A * | 10/1996 | Schoenwald et al. | 363/132 |
| 5,874,828 | A * | 2/1999 | Lee | 323/274 |
| 2005/0259057 | A1 | 11/2005 | Lee et al. | 245/87 |
| 2006/0001600 | A1 | 1/2006 | Ito | 345/60 |

FOREIGN PATENT DOCUMENTS

| | | | |
|---|---|---|---|
| EP | 1 387345 | A2 | 2/2004 |
| JP | 2002-170482 | | 6/2002 |
| KR | 10-2005-0112851 | A | 12/2005 |
| KR | 10-0626073 | B1 | 9/2006 |

OTHER PUBLICATIONS

European Search Report dated Oct. 27, 2008.

* cited by examiner

*Primary Examiner* — Ricardo L Osorio
(74) *Attorney, Agent, or Firm* — Ked and Assoicates LLP

(57) ABSTRACT

A plasma display apparatus and a method of driving the same are disclosed. The plasma display apparatus includes a plasma display panel including first electrodes, second electrodes, and third electrodes, a first driver, a second driver, and a reference separation controller. The first driver supplies sustain signals each including a positive polarity sustain signal and a negative polarity sustain signal to the first electrodes during a sustain period, and supplies a ground level voltage during at least one time interval between the positive polarity sustain signals and the negative polarity sustain signals. The reference separation controller connects or separates a first reference voltage source commonly connected to the first driver and the second electrodes to or from a second reference voltage source connected to the second driver.

23 Claims, 9 Drawing Sheets

PLASMA DISPLAY APPARATUS AND METHOD OF DRIVING THE SAME

This application claims the benefit of Korean Patent Application No. 10-2006-0130123 filed on Dec. 19, 2006, which is hereby incorporated by reference.

BACKGROUND OF THE DISCLOSURE

1. Field of the Disclosure

An exemplary embodiment relates to a plasma display apparatus and a method of driving the same.

2. Description of the Background Art

A plasma display apparatus generally includes a plasma display panel displaying an image, and a driver attached to the rear of the plasma display panel to drive the plasma display panel.

The plasma display panel has the structure in which barrier ribs formed between a front substrate and a rear substrate form unit discharge cell or discharge cells. Each discharge cell is filled with an inert gas containing a main discharge gas such as neon (Ne), helium (He) or a mixture of Ne and He, and a small amount of xenon (Xe). The plurality of discharge cells form one pixel. For instance, a red (R) discharge cell, a green (G) discharge cell, and a blue (B) discharge cell form one pixel.

When the plasma display panel is discharged by a high frequency voltage, the inert gas generates vacuum ultraviolet rays, which thereby cause phosphors formed between the barrier ribs to emit light, thus displaying an image.

The study of an increase in life span of the plasma display apparatus has continued.

SUMMARY OF THE DISCLOSURE

In one aspect, a plasma display apparatus comprises a plasma display panel including first electrodes, second electrodes, and third electrodes positioned in an intersection direction of the first electrodes and the second electrodes, a first driver that supplies sustain signals each including a positive polarity sustain signal and a negative polarity sustain signal to the first electrodes during a sustain period, and supplies a ground level voltage during at least one time interval between the positive polarity sustain signals and the negative polarity sustain signals, a second driver that supplies data signals to the third electrodes during an address period, and a reference separation controller that connects or separates a first reference voltage source commonly connected to the first driver and the second electrodes to or from a second reference voltage source connected to the second driver.

The first driver may supply the ground level voltage during at least one of a time interval between after the supply of the positive polarity sustain signal and before the supply of the negative polarity sustain signal or a time interval between after the supply of the negative polarity sustain signal and before the supply of the positive polarity sustain signal.

A supply period of the ground level voltage may lie substantially in a range between 1 ns and 20 μs.

The first driver may supply a first negative polarity sustain signal and then a first positive polarity sustain signal. A supply period of the ground level voltage during a time interval between after the supply of the first negative polarity sustain signal and before the supply of the first positive polarity sustain signal may be long enough to include a predetermined number of sustain signals.

The first driver may supply a first negative polarity sustain signal and then a first positive polarity sustain signal, and the first driver supplies a second negative polarity sustain signal and then a second positive polarity sustain signal. The ground level voltage may be supplied during a first supply period before the supply of the first positive polarity sustain signal and during a second supply period before the supply of the second positive polarity sustain signal. A time length of the first supply period may be different from a time length of the second supply period.

A rising slope of the positive polarity sustain signal may be different from a rising slope of the negative polarity sustain signal, or a falling slope of the positive polarity sustain signal may be different from a falling slope of the negative polarity sustain signal.

An absolute value of the rising slope of the positive polarity sustain signal may be larger than an absolute value of the rising slope of the negative polarity sustain signal.

An absolute value of the falling slope of the positive polarity sustain signal may be smaller than an absolute value of the falling slope of the negative polarity sustain signal.

The two first electrodes may be successively positioned, and the two second electrodes may be successively positioned. An absolute value of a rising slope of the positive polarity sustain signal may be smaller than an absolute value of a falling slope of the negative polarity sustain signal.

The reference separation controller may be turned off during the supply of the positive polarity sustain signal to the first electrode so that the first reference voltage source is separated from the second reference voltage source.

The reference separation controller may be turned on during the remaining period except the supply period of the positive polarity sustain signal from the sustain period so that the first reference voltage source is connected to the second reference voltage source.

The reference separation controller may be turned off during the remaining period except the supply period of the positive polarity sustain signal from the sustain period so that the first reference voltage source is separated from the second reference voltage source.

In another aspect, a method of driving a plasma display apparatus including a plasma display panel including first electrodes, second electrodes, and third electrodes, a first driver driving the first electrodes, a second driver driving the third electrodes, a first reference voltage source commonly connected to the first driver and the second electrodes, and a second reference voltage source connected to the second driver, the method comprises supplying sustain signals each including a positive polarity sustain signal and a negative polarity sustain signal to the first electrodes during a sustain period, supplying a ground level voltage during at least one time interval between the positive polarity sustain signals and the negative polarity sustain signals, and separating the first reference voltage source from the second reference voltage source during the supply of the positive polarity sustain signal to the first electrode.

The method may further comprise connecting the first reference voltage source to the second reference voltage source during the remaining period except the supply period of the positive polarity sustain signal from the sustain period.

The method may further comprise separating the first reference voltage source from the second reference voltage source during the remaining period except the supply period of the positive polarity sustain signal from the sustain period.

Supplying the ground level voltage may be performed during at least one of a time interval between after the supply of the positive polarity sustain signal and before the supply of the negative polarity sustain signal or a time interval between after the supply of the negative polarity sustain signal and before the supply of the positive polarity sustain signal.

A supply period of the ground level voltage may lie substantially in a range between 1 ns and 20 μs.

Supplying the sustain signal may include supplying a first negative polarity sustain signal and then supplying a first positive polarity sustain signal. A supply period of the ground level voltage during a time interval between after the supply of the first negative polarity sustain signal and before the supply of the first positive polarity sustain signal may be long enough to include a predetermined number of sustain signals.

Supplying the sustain signal may include supplying a first negative polarity sustain signal and then supplying a first positive polarity sustain signal, and supplying the sustain signal may include supplying a second negative polarity sustain signal and then supplying a second positive polarity sustain signal. The ground level voltage may be supplied during a first supply period before the supply of the first positive polarity sustain signal and during a second supply period before the supply of the second positive polarity sustain signal. A time length of the first supply period may be different from a time length of the second supply period.

A rising slope of the positive polarity sustain signal may be different from a rising slope of the negative polarity sustain signal, or a falling slope of the positive polarity sustain signal may be different from a falling slope of the negative polarity sustain signal.

An absolute value of the rising slope of the positive polarity sustain signal may be larger than an absolute value of the rising slope of the negative polarity sustain signal.

An absolute value of the falling slope of the positive polarity sustain signal may be smaller than an absolute value of the falling slope of the negative polarity sustain signal.

The two first electrodes may be successively positioned, and the two second electrodes may be successively positioned. An absolute value of a rising slope of the positive polarity sustain signal may be smaller than an absolute value of a falling slope of the negative polarity sustain signal.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

Figure 1:
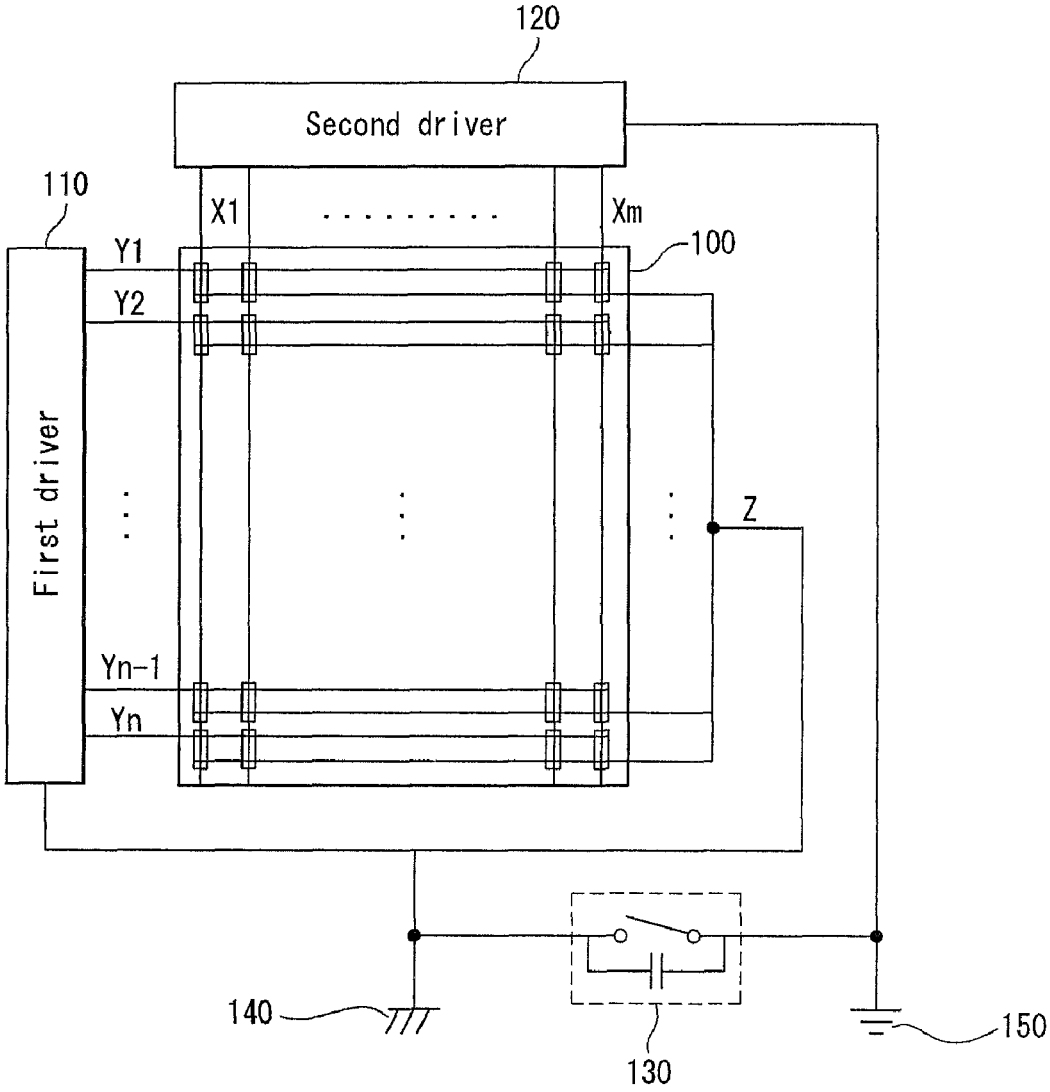
FIG. 1 shows a plasma display apparatus according to an exemplary embodiment.

FIG. 1 shows a plasma display apparatus according to an exemplary embodiment.

As sown in FIG. 1, a plasma display apparatus according to an exemplary embodiment includes a plasma display panel 100, a first driver 110, a second driver 120, and a reference separation controller 130.

The plasma display panel 100 includes first electrodes Y1-Yn, second electrodes Z, and third electrodes X1-Xm positioned in an intersection direction of the first electrodes Y1-Yn and the second electrodes Z. One terminal of the first driver 110 is electrically connected to the first electrodes Y1-Yn, and the other terminal is electrically connected to the second electrodes Z and a first reference voltage source 140. One terminal of the second driver 120 is electrically connected to the third electrodes X1-Xm, and the other terminal is electrically connected to a second reference voltage source 150. The reference separation controller 130 is electrically connected between the first reference voltage source 140 and the second reference voltage source 150.

The first driver 110 includes a sustain driver, and the second driver 120 includes a data driver. The first driver 110 drives the first electrodes Y1-Yn. The sustain driver supplies sustain signals to the first electrodes Y1-Yn, thereby maintaining a discharge. Hence, an image is displayed.

The first driver 110 may supply reset signals to the first electrodes Y1-Yn during a reset period to initialize wall charges distributed in discharge cells, may supply a scan reference voltage and scan signals to the first electrodes Y1-Yn during an address period, and may supply sustain signals each including a positive polarity sustain signal and a negative polarity sustain signal to the first electrodes Y1-Yn during a sustain period. Further, a ground level voltage is supplied during at least one time interval between the positive polarity sustain signals and the negative polarity sustain signals.

Voltage sources of the first driver 110 supply voltages based on the first reference voltage source 140. For instance, a sustain voltage source generating a voltage of the sustain signal and a setup voltage source generating a setup signal of the reset signal supply a voltages having a predetermined magnitude based on the first reference voltage source 140.

The first reference voltage source 140 may form a first reference voltage, and may be formed in a predetermined area using an electrically conductive material. For instance, the first reference voltage source 140 may be a frame, and formed in the form of a cooper foil having a predetermined area while being electrically separated from a frame. Further, the first reference voltage source 140 may be formed by attaching an electrically conductive material to a case of the plasma display apparatus. The first reference voltage source 140 may be variously formed.

The data driver of the second driver 120 supplies a data signal to the third electrodes X1-Xm. A data voltage sources generating the data signal supplies a data voltage of the data signal based on the second reference voltage source 150. The second reference voltage source 150 may form a second reference voltage while being electrically separated from the first reference voltage source 140. The second reference voltage source 150 may be variously formed in the same way as the first reference voltage source 140.

The reference separation controller 130 electrically separates the first reference voltage source 140 connected to the sustain driver from the second reference voltage source 150 connected to the data driver. Hence, while the driving signal is supplied to the first electrodes Y1-Yn, the third electrodes X1-Xm are floated and have a predetermined voltage. The reference separation controller 130 may include a parasitic capacitor virtually generated by a switch.

When the sustain driver supplies the sustain signal to the first electrodes Y1-Yn during the sustain period, an opposite discharge occurs inside the discharge cell.

When the reference separation controller 130 electrically separates the first reference voltage source 140 from the second reference voltage source 150, there is a voltage difference between the first reference voltage source 140 and the second reference voltage source 150. Hence, a floating voltage can be generated in the third electrodes X1-Xm depending on a change in the driving signal supplied to the first electrodes Y1-Yn. The opposite discharge can be prevented due to the floating voltage, and a damage to a phosphor caused by the opposite discharge can be prevented.

Accordingly, a discharge efficiency and a driving efficiency can be improved by preventing the damage to the phosphor. Furthermore, life span of the plasma display apparatus can increase.

Figure 2:
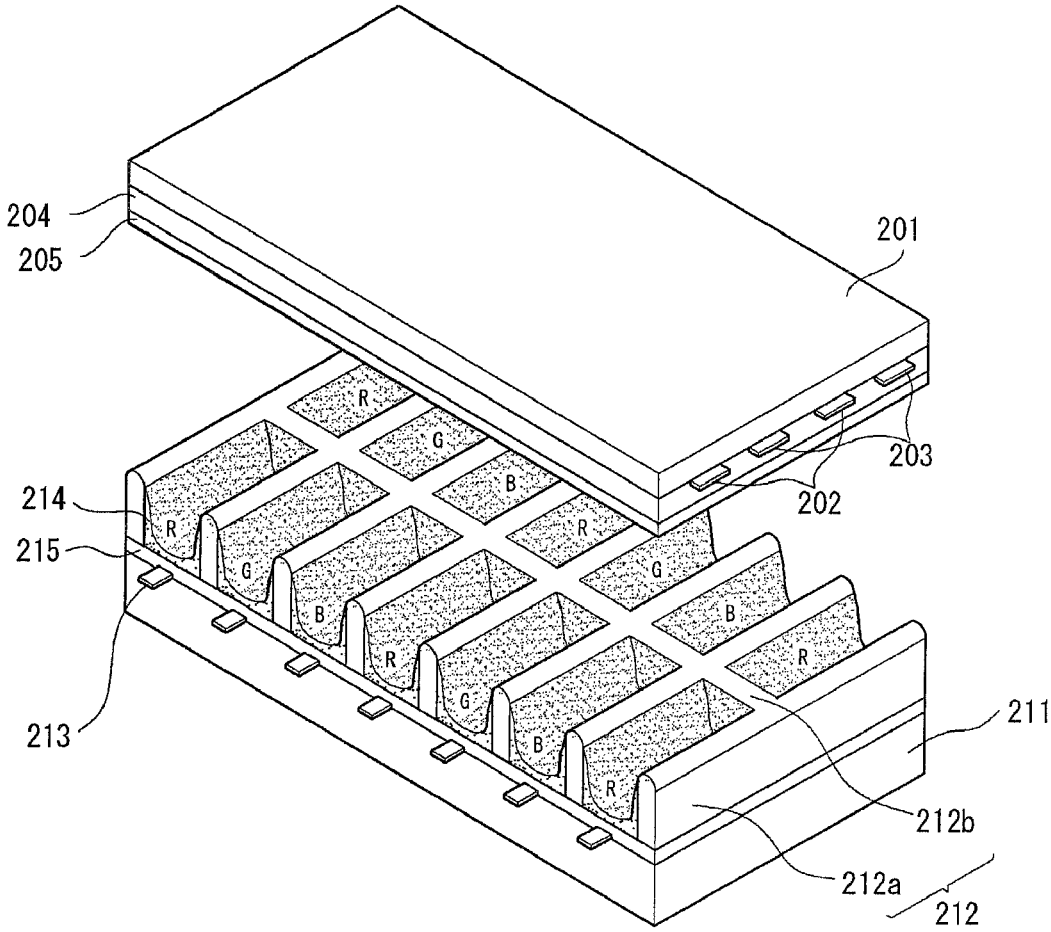
FIG. 2 shows an example of a structure of a plasma display panel of FIG. 1.

FIG. 2 shows an example of a structure of a plasma display panel of FIG. 1.

As shown in FIG. 2, the plasma display panel 100 according to the exemplary embodiment includes a front substrate 201, on which a first electrode 202 and a second electrode 203 are positioned parallel to each other, and a rear substrate 211 on which a third electrode 213 is positioned to intersect the first electrode 202 and the second electrode 203.

The first electrode 202 and the second electrode 203 can generate a discharge inside the discharge cell and maintain the discharge.

An upper dielectric layer 204 is positioned on the front substrate 201, on which the first electrode 202 and the second electrode 203 are positioned, to cover the first electrode 202 and the second electrode 203. The upper dielectric layer 204 limits discharge currents of the first electrode 202 and the second electrode 203 and provides electrical insulation between the first electrode 202 and the second electrode 203.

A protective layer 205 is positioned on the upper dielectric layer 204 to facilitate discharge conditions. The protective layer 205 may be formed using a method of depositing a material such as magnesium oxide (MgO) on the upper dielectric layer 204.

A lower dielectric layer 215 is positioned on the rear substrate 211, on which the third electrode 213 is positioned, to cover the third electrode 213. The lower dielectric layer 215 provides electrical insulation of the third electrodes 213.

Barrier ribs 212 of a stripe type, a well type, a delta type, a honeycomb type, and the like, may be positioned on the lower dielectric layer 215 to partition the discharge cells. A red (R) discharge cell, a green (G) discharge cell, and a blue (B) discharge cell, and the like, may be positioned between the front substrate 201 and the rear substrate 211. In addition to the red (R), green (G), and blue (B) discharge cells, a white discharge cell or a yellow discharge cell may be further formed.

Widths of the red (R), green (G), and blue (B) discharge cells may be substantially equal to one another. Otherwise, a width of at least one of the red (R), green (G), or blue (B) discharge cells may be different from widths of the other discharge cells so as to improve a color temperature of an image displayed on the plasma display panel 100. For instance, a width of the red (R) discharge cell may be the smallest, and widths of the green (G) and blue (B) discharge cells may be larger than the width of the red (R) discharge cell. The width of the green (C) discharge cell may be substantially equal or different from the width of the blue (B) discharge cell.

The plasma display panel according to the exemplary embodiment may have various forms of barrier rib structures as well as the structure of the barrier rib 212 shown in FIG. 2. For instance, the barrier rib 212 may include a first barrier rib 212*b* and a second barrier rib 212*a*. The barrier rib 212 may have a differential type barrier rib structure in which a height of the first barrier rib 212*b* and a height of the second barrier rib 212*a* are different from each other, a channel type barrier rib structure in which a channel usable as an exhaust path is formed on at least one of the first barrier rib 212*b* or the second barrier rib 212*a*, a hollow type barrier rib structure in which a hollow is formed on at least one of the first barrier rib 212*b* or the second barrier rib 212*a*, and the like.

In the differential type barrier rib structure, a height of the first barrier rib 212*b* may be smaller than a height of the second barrier rib 212*a*. Further, in the channel type barrier rib structure or the hollow type barrier rib structure, a channel or a hollow may be formed on the first barrier rib 212*b*.

While FIG. 2 has been illustrated and described the case where the red (R), green (G) and blue (B) discharge cells are arranged on the same line, the red (R), green (G) and blue (B) discharge cells may be arranged in a different pattern. For instance, a delta type arrangement in which the red (R), green (G), and blue (B) discharge cells are arranged in a triangle shape may be applicable. Further, the discharge cells may have a variety of polygonal shapes such as pentagonal and hexagonal shapes as well as a rectangular shape.

While FIG. 2 has illustrated and described the case where the barrier rib 212 is formed on the rear substrate 211, the barrier rib 212 may be formed on at least one of the front substrate 201 or the rear substrate 211.

Each discharge cell partitioned by the barrier ribs 212 may be filled with a predetermined discharge gas.

A phosphor layer 214 is positioned inside the discharge cells to emit visible light for an image display during an address discharge. For instance, red, green, and blue phosphor layers may be positioned inside the discharge cells. In addition to the red, green, and blue phosphor layers, at least one of white or yellow phosphor layer may be further formed.

Thicknesses of the phosphor layers 214 formed inside the red (R), green (G) and blue (B) discharge cells may be substantially equal to one another. Otherwise, a thickness of at least one of the phosphor layers 214 formed inside the red (R), green (G) and blue (B) discharge cells may be different from thicknesses of the other phosphor layers. For instance, a thickness of the green phosphor layer or the blue phosphor layer may be larger than a thickness of the red phosphor layer. The thickness of the green phosphor layer may be substantially equal or different from the thickness of the blue phosphor layer.

Figure 3:
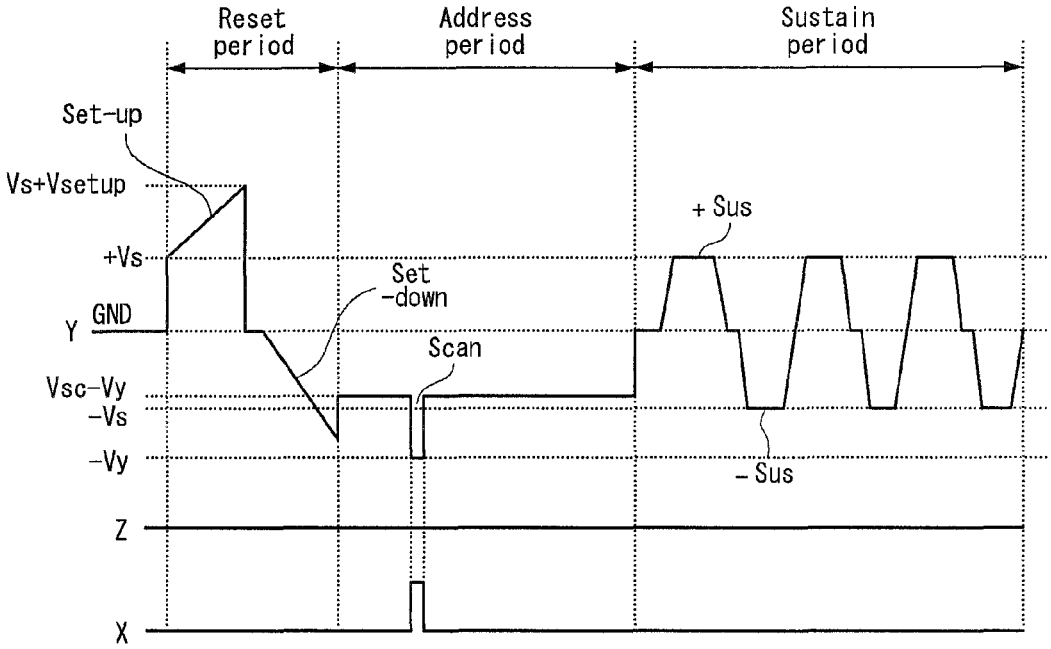
FIG. 3 shows an example of a method of driving the plasma display panel.

FIG. 3 shows an example of a method of driving the electrodes of the plasma display panel 100 by the drivers 110 and 120 of FIG. 1.

As shown in FIG. 3, the first and second drivers 110 and 120 of FIG. 1 supply driving signals to the first electrode Y and the third electrode X during at least one of a reset period, an address period, and a sustain period.

The reset period is divided into a setup period and a set-down period. During the setup period, the first driver 110 may supply a setup signal (Set-up) to the first electrode Y. The setup signal generates a weak dark discharge within the discharge cells of the whole screen. This results in wall charges of a positive polarity being accumulated on the second electrode Z and the third electrode X, and wall charges of a negative polarity being accumulated on the first electrode Y.

During the set-down period, the first driver 110 may supply a set-down signal (Set-down) which falls from a positive voltage level lower than the highest voltage of the setup signal (Set-up) to a given voltage level lower than a ground level voltage GND to the first electrode Y, thereby generating a weak erase discharge within the discharge cells. Furthermore, the remaining wall charges are uniform inside the discharge cells to the extent that the address discharge can be stably performed.

During the address period, the first driver 110 may supply a scan signal (Scan) of a negative polarity falling from a scan bias voltage (Vsc-Vy) to the first electrode Y. The second driver 120 may supply a data signal of a positive polarity to the third electrode X in synchronization with the scan signal (Scan). Since the scan signal (Scan) having a voltage lower than a lowest voltage −Vy of the set-down signal (Set-down) is supplied, and at the scam time, the data signal is supplied to the third electrode X, a voltage of the data signal can be lowered. Hence, energy consumption can be reduced. As a voltage difference between the scan signal (Scan) and the data signal is added to the wall voltage generated during the reset period, an address discharge is generated within the discharge cells to which the data signal is applied. Wall charges are formed inside the discharge cells selected by performing the address discharge to the extent that a discharge occurs whenever a sustain voltage is applied. Hence, the first electrode Y is scanned.

During the sustain period, the sustain driver of the first driver 110 supplies sustain signals each including a positive polarity sustain signal (+Sus) and a negative polarity sustain signal (−Sus) to the first electrode Y. The ground level voltage GND is supplied to the first electrode Y during at least one time interval between the positive polarity sustain signals (+Sus) and the negative polarity sustain signals (−Sus).

In FIG. 3, as an example of the supply of the ground level voltage GND, the sustain driver supplies the ground level voltage GND to the first electrode Y during a time interval between after the supply of the positive polarity sustain signal (+Sus) and before the supply of the negative polarity sustain signal (−Sus).

Since the ground level voltage GND is supplied during at least one time interval between the positive polarity sustain signals (+Sus) and the negative polarity sustain signals (−Sus), a frequency or a period of the sustain signal can change stably or a slope of the sustain signal can change stably in a stable state of all the discharge cells.

When a luminance of the plasma display panel is reduced by omitting a predetermined number of sustain signals during a predetermined time interval, the luminance of the plasma display panel can be stably reduced by supplying the ground level voltage GND during the predetermined time interval.

As above, since the ground level voltage GND is maintained during at least a portion of the sustain period, the frequency, the period, and the slope of the sustain signal can freely change.

As the wall voltage inside the discharge cells selected by performing the address discharge is added to the sustain signal, every time the sustain signal is applied, a sustain discharge, i.e., a display discharge is generated between the first electrode Y and the second electrode Z. An erase period may be added in the exemplary embodiment.

Figure 4:
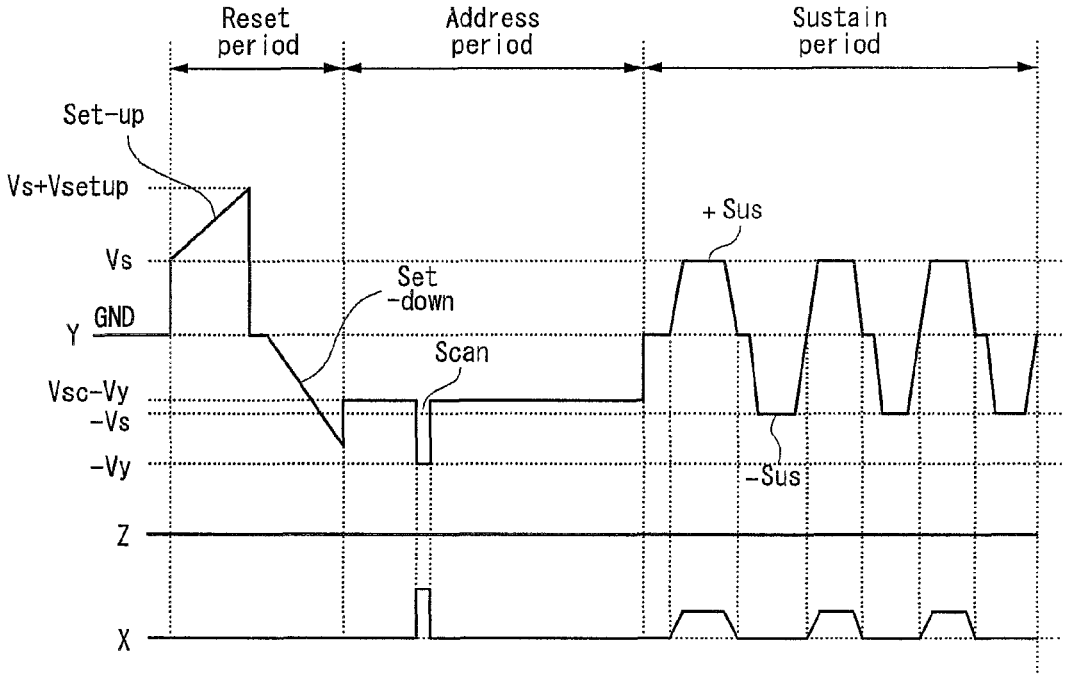
FIGS. 4 and 5 are diagrams for explaining a floating of a third electrode during a sustain period.
Figure 5:
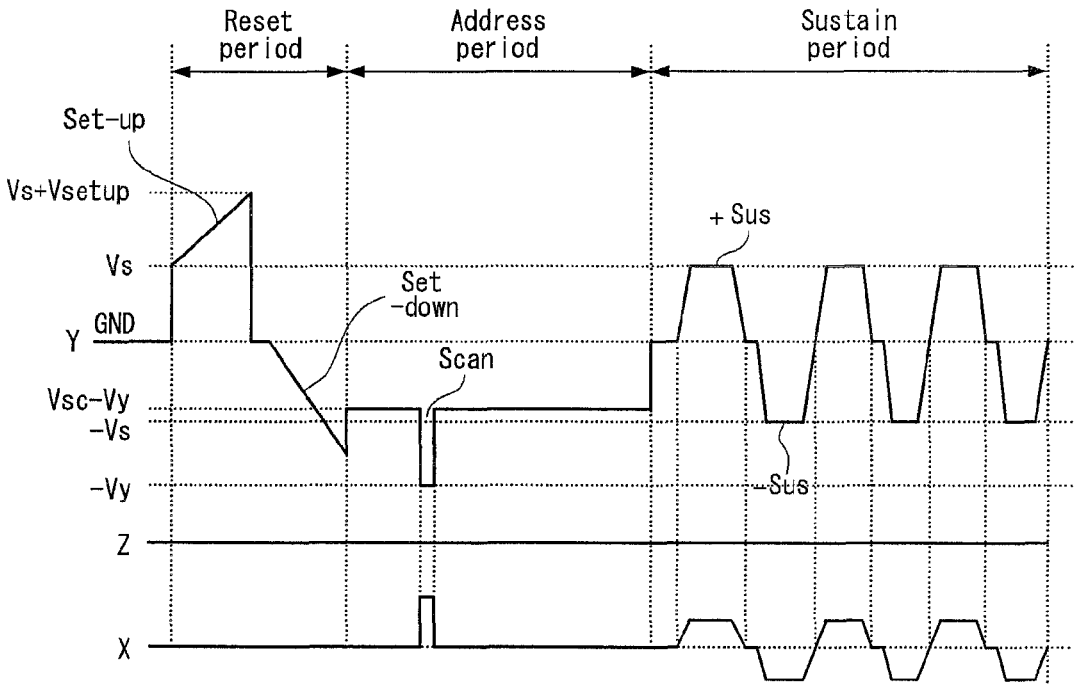

FIGS. 4 and 5 are diagrams for explaining a floating of a third electrode during a sustain period.

As shown in FIG. 4, the sustain driver supplies sustain signals each including a positive polarity sustain signal (+Sus) and a negative polarity sustain signal (−Sus) to the first electrode Y during a sustain period. The ground level voltage GND may be supplied during at least one time interval between the positive polarity sustain signals (+Sus) and the negative polarity sustain signals (−Sus), and the third electrode X may be floated during the supply of the positive polarity sustain signals (+Sus).

In other words, the sustain driver supplies the ground level voltage GND to the first electrode Y while a voltage level of the sustain signal falls from a positive sustain voltage +Vs to a negative sustain voltage −Vs, and the third electrode X is floated during the supply of the positive polarity sustain signals (+Sus). Hence, a signal having the same period as the sustain signal and a voltage magnitude smaller than a voltage magnitude of the sustain signal may be generated in the third electrode X depending on the sustain signal.

More specifically, the reference separation controller 130 is turned off during a supply period of the positive sustain voltage +Vs, and thus a predetermined floating voltage can be generated in the third electrode X. The reference separation controller 130 is turned on during the remaining period except the supply period of the positive sustain voltage +Vs from the sustain period, and thus the ground level voltage GND can be generated in the third electrode X.

The predetermined floating voltage can prevent an opposite discharge between the third electrode X and the first electrode Y or between the third electrode X and the second electrode Z during the sustain period.

More specifically, an opposite discharge generally occurs when a voltage difference between the electrodes is equal to or higher than a predetermined voltage level. Because a voltage difference between the third electrode X and the first electrode Y or a voltage difference between the third electrode X and the second electrode Z decreases due to the floating voltage of the third electrode X, the opposite discharge can be prevented.

A damage to the phosphor can be prevented by preventing the opposite discharge, and also a reduction in a driving characteristic of the plasma display panel can be prevented. Hence, life span of the plasma display panel can increase.

Although FIG. 4 has illustrated and described a case where the third electrode X is floated during the sustain period, the third electrode X may be floated during the reset period or address period. Further, when the third electrode X is floated during the reset period, an improvement effect of a contrast ratio can be obtained in addition to the prevention of an opposite discharge.

Further, the floating of the third electrode X during the sustain period is applicable to a case of various forms of sustain signal to be described later.

As shown in FIG. 5, the sustain driver supplies sustain signals each including a positive polarity sustain signal (+Sus) and a negative polarity sustain signal (−Sus) to the first electrode Y during a sustain period. The ground level voltage GND may be supplied during at least one time interval between the positive polarity sustain signals (+Sus) and the negative polarity sustain signals (−Sus), and a signal having the same period as the sustain signal and a voltage magnitude smaller than a voltage magnitude of the sustain signal may be generated in the third electrode X.

In other words, the sustain driver supplies the ground level voltage GND to the first electrode Y while a voltage level of the sustain signal falls from the positive sustain voltage +Vs to the negative sustain voltage −Vs, and the third electrode X is floated during the sustain period. Hence, the signal having the same period as the sustain signal and the voltage magnitude smaller than the voltage magnitude of the sustain signal may be generated in the third electrode X depending on the sustain signal.

More specifically, the reference separation controller 130 is turned off during a supply period of the positive sustain voltage +Vs, and thus a predetermined floating voltage can be generated in the third electrode X. The reference separation controller 130 is turned off during the remaining period except the supply period of the positive sustain voltage +Vs from the sustain period, and thus a predetermined floating voltage can be generated in the third electrode X.

The predetermined floating voltage can prevent an opposite discharge between the third electrode X and the first electrode Y or between the third electrode X and the second electrode Z during the sustain period.

Figure 6A:
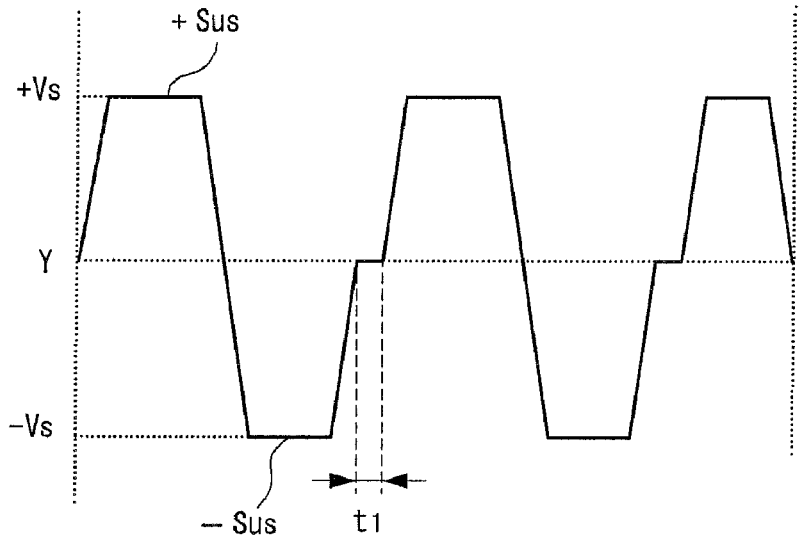
FIGS. 6A and 6B show another form of a sustain signal having a ground level voltage during a predetermined time period in the driving method illustrated in FIG. 3.
Figure 6B:
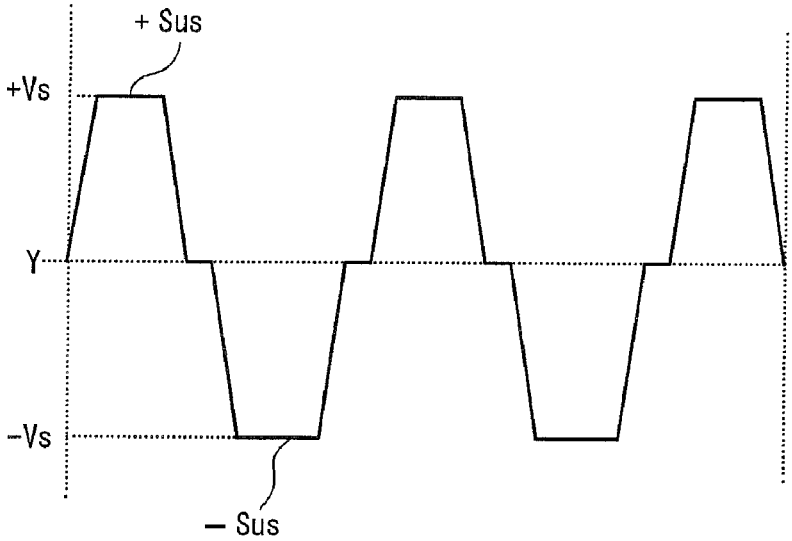

FIGS. 6A and 6B show another form of a sustain signal having a ground level voltage during a predetermined time period in the driving method illustrated in FIG. 3.

As shown in FIG. 6A, the sustain driver may supply the ground level voltage GND to the first electrode Y during a time interval between after the supply of the negative polarity sustain signal (−Sus) and before the supply of the positive polarity sustain signal (+Sus). As shown in FIG. 6B, the sustain driver may supply the ground level voltage GND to the first electrode Y during a time interval between after the supply of the positive polarity sustain signal (+Sus) and before the supply of the negative polarity sustain signal (−Sus) and during a time interval between after the supply of the negative polarity sustain signal (−Sus) and before the supply of the positive polarity sustain signal (+Sus).

A width of the positive polarity sustain signal (+Sus) may be substantially equal to or different from a width of the negative polarity sustain signal (−Sus).

FIGS. 6A and 6B have illustrated and described a case where a rising slope and a falling slope of the positive polarity sustain signal (+Sus) are substantially equal to a rising slope and a falling slope of the negative polarity sustain signal (−Sus), respectively. However, the rising slope and the falling slope of the positive polarity sustain signal (+Sus) may be different from the rising slope and the falling slope of the negative polarity sustain signal (−Sus), respectively. The slope difference will be described later with reference to FIGS. 8A and 8B.

A supply period t1 of the ground level voltage GND may be equal to or longer than 1 ns. A reason why the supply period t1 is equal to or longer than 1 ns is to secure a driving margin for stable switching operations of a circuit of the sustain driver in case that the rising slope of the positive polarity sustain signal (+Sus) is different from the rising slope of the negative polarity sustain signal (−Sus) or the falling slope of the positive polarity sustain signal (+Sus) is different from the falling slope of the negative polarity sustain signal (−Sus)

Accordingly, a frequency, a period or slope of the sustain signal or the luminance of the plasma display panel can stably change in a stable state of the discharge cell where there is no voltage received from the outside.

When a luminance of the plasma display panel is reduced by omitting a predetermined number of sustain signals during a predetermined time interval, the luminance of the plasma display panel can be stably reduced by supplying the ground level voltage GND during the predetermined time interval.

Figure 7A:
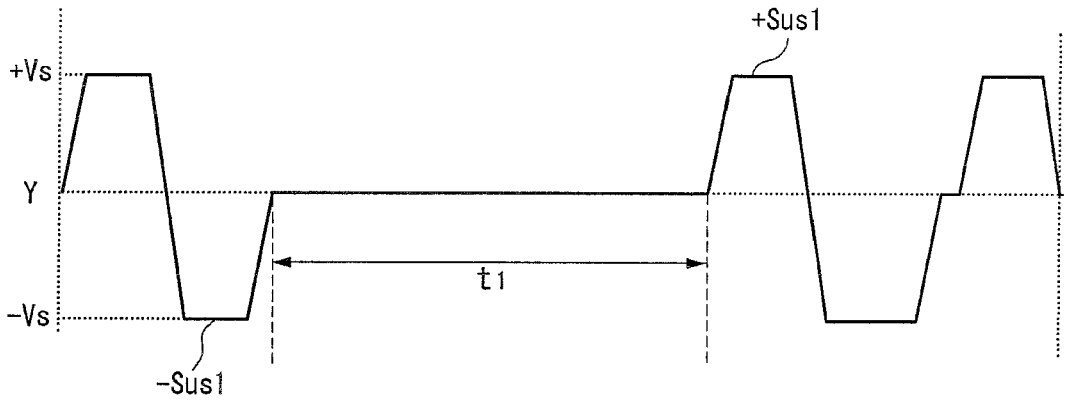
FIGS. 7A and 7B show another form of a sustain signal having a ground level voltage during a predetermined time period in the driving method illustrated in FIG. 3.
Figure 7B:
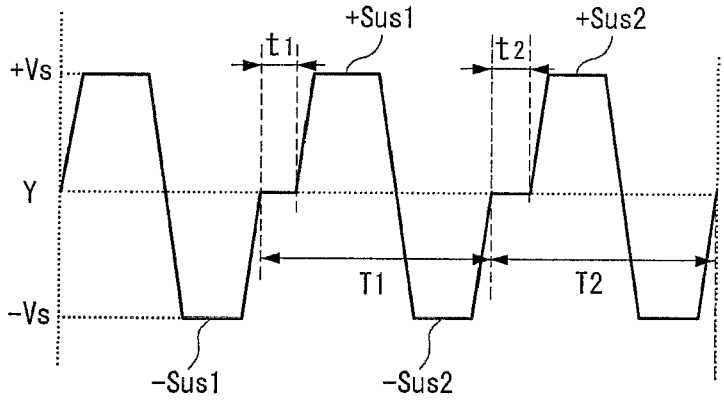

FIGS. 7A and 7B show another form of a sustain signal having a ground level voltage during a predetermined time period in the driving method illustrated in FIG. 3.

As shown in FIG. 7A, the sustain driver supplies the ground level voltage GND instead of a predetermined number of sustain signals to the first electrode Y during a time interval t1 between after the supply of a first negative polarity sustain signal (−Sus1) and before the supply of a first positive polarity sustain signal (+Sus1), and thus can reduce a luminance of the plasma display panel.

As shown in FIG. 7B, the sustain driver supplies a first negative polarity sustain signal (−Sus1) and then a first positive polarity sustain signal (+Sus1). Further, the sustain driver supplies a second negative polarity sustain signal (−Sus2) and then a second positive polarity sustain signal (+Sus2). The ground level voltage GND is supplied during a first supply period t1 before the supply of the first positive polarity sustain signal (+Sus1) and during a second supply period t2 before the supply of the second positive polarity sustain signal (+Sus2). Hence, the luminance of the plasma display panel can be reduced by properly adjusting periods T1 and T2 of the sustain signals.

A supply period of the ground level voltage GND may be equal to or shorter than 20 μs. A reason why the supply period of the ground level voltage GND is equal to or shorter than 20 μs is that an energy recovery efficiency can be improved by properly setting a frequency of the sustain signal during an operation of an energy recovery circuit included in the sustain driver. Hence, power consumption can be reduced.

A time length of the first supply period t1 may be substantially equal to or different from a time length of the second supply period t2. Therefore, the period T1 may be substantially equal to or different from the period T2.

When the period T1 is different from the period T2, a moving pattern of wall charges a periodically changes. Hence, image sticking generated when a moving pattern of wall charges periodically changes can be prevented.

Figure 8A:
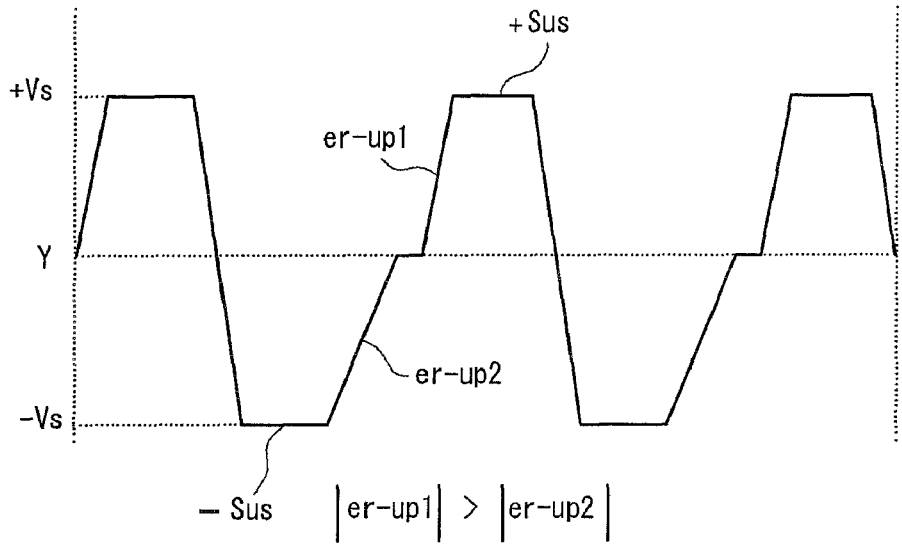
FIGS. 8A and 8B show a sustain signal having different slopes.
Figure 8B:
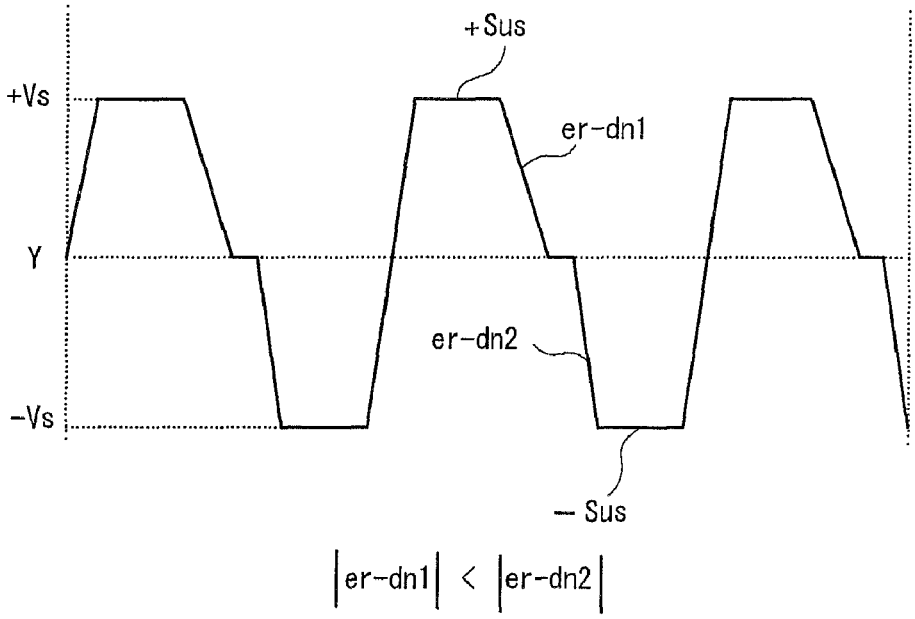

FIGS. 8A and 8B show a sustain signal having different slopes.

The sustain driver may supply a sustain signal whose a rising slope of a positive polarity sustain signal is different from a rising slope of a negative polarity sustain signal. As shown in FIG. 8A, an absolute value of a rising slope (er_up1) of a positive polarity sustain signal (+Sus) may be larger than an absolute value of a rising slope (er_up2) of a negative polarity sustain signal (−Sus).

Further, the sustain driver may supply a sustain signal whose a falling slope of a positive polarity sustain signal is different from a falling slope of a negative polarity sustain signal. As shown in FIG. 8B, an absolute value of a falling slope (er_dn1) of a positive polarity sustain signal (+Sus) may be smaller than an absolute value of a falling slope (er_dn2) of a negative polarity sustain signal (−Sus).

Hence, a sustain discharge generated when the positive polarity sustain signal (+Sus) rises or a sustain discharge generated when the negative polarity sustain signal (−Sus) falls occurs more rapidly, and thus a jitter characteristic can be improved.

Further, a difference in the quantity of light between the sustain discharges of the sustain signal can be controlled by setting the slopes of the sustain signal to be different from each other. This will be described below with reference to FIG. 9.

Figure 9A:
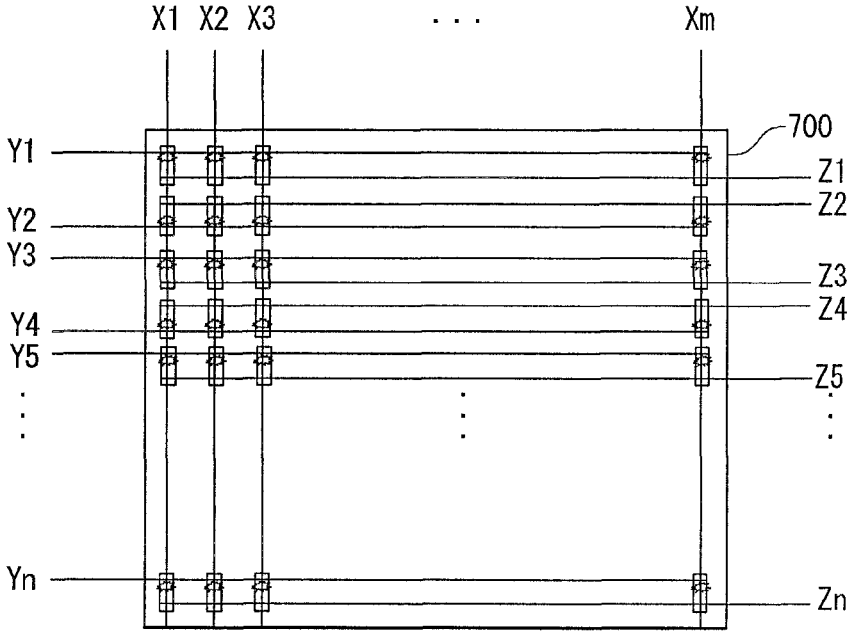
FIGS. 9A and 9B show another example of a structure of the plasma display panel according to the exemplary embodiment.
Figure 9B:
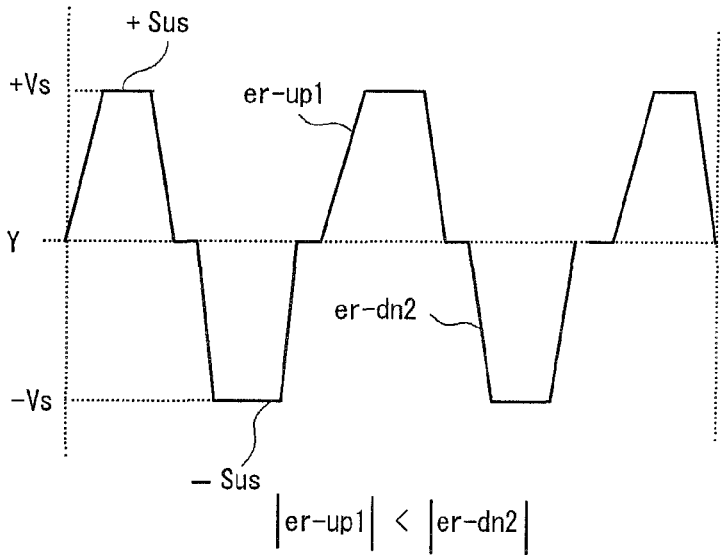

FIGS. 9A and 9B show another example of a structure of the plasma display panel according to the exemplary embodiment.

As shown in FIG. 9A, in the first electrodes Y1-Yn, two first electrodes are successively positioned. For instance, the first electrodes Y2 and Y3 are successively positioned, and the first electrodes Y4 and Y5 are successively positioned. In the same way as the first electrodes Y1-Yn, in the second electrodes Z1-Zn, two second electrodes are successively positioned. For instance, the second electrodes Z1 and Z2 are successively positioned, and the second electrodes Z3 and Z4 are successively positioned. The second electrodes Z1-Zn are connected to the first reference voltage source, as in FIG. 1.

When sustain signals having an equal width, an equal slope and an equal voltage magnitude are supplied to the first electrodes Y1-Yn, as shown in FIG. 9A, sustain discharges occur close to the first electrodes Y1-Yn.

In this case, occurrence locations of the sustain discharges inside the discharge cells are not uniform. For instance, in a case of a discharge cell through which the first electrode Y2 passes, most of sustain discharge occurs in a lower portion of the discharge cell. In a case of a discharge cell through which the first electrode Y3 passes, most of sustain discharge occurs in an upper portion of the discharge cell. Because an interval between the first electrodes Y2 and Y3 is narrow, an interval between the first electrodes Y4 and Y5 is narrow, and an interval between the first electrodes Y3 and Y4 is wide, a dark portion and a bright portion are periodically repeated on the entire screen of the plasma display panel. Hence, light is generated nonuniformly.

The difference in the quantity of light can be prevented by supplying a sustain signal having different slopes, as shown in FIG. 9B. More specifically, a positive polarity sustain signal (+Sus) whose a rising slope is relatively small is supplied, and thus an intensity of a sustain discharge occurring close to the first electrodes Y1-Yn may be relatively weak. A negative polarity sustain signal (−Sus) whose a falling slope is relatively large is supplied, and thus an intensity of a sustain discharge occurring close to the second electrodes Z1-Zn may be relatively large. More specifically, an absolute value of the rising slope of the positive polarity sustain signal (+Sus) may be smaller than an absolute value of the falling slope of the negative polarity sustain signal (−Sus). Accordingly, the difference in the quantity of light can be prevented, and the sustain discharge can occur in the center of the discharge cell.

As described above, since the plasma display apparatus according to the exemplary embodiment includes the reference separation controller between the first reference voltage source connected to the first driver and the second reference voltage source connected to the second driver by applying a new circuit idea thereto, various driving methods using the reference separation controller can be provided and the third electrode can be floated during the sustain period.

The opposite discharge during the sustain period can be prevented by the floating of the third electrode, and thus the driving efficiency can be improved. Further, a damage to the phosphor caused by the opposite discharge can be improved and thus life span of the plasma display panel can increase.

Because the ground level voltage is supplied during at least a portion of the sustain period, a period, a frequency, and a slope of the sustain signal can freely change.

Because the sustain signal having different slopes is supplied, a difference in the quantity of light of the sustain signal can be controlled.

Embodiments of the invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. A plasma display apparatus comprising:

a plasma display panel including first electrodes, second electrodes, and third electrodes positioned in an intersection direction of the first electrodes and the second electrodes;

a first driver that supplies sustain signals each including a positive polarity sustain signal and a negative polarity sustain signal to the first electrodes during a sustain period, and supplies a ground level voltage during at least one time interval between the positive polarity sustain signals and the negative polarity sustain signals;

a second driver that supplies data signals to the third electrodes during an address period; and a reference separation controller that connects or separates a first reference voltage source commonly connected to the first driver and the second electrodes to or from a second reference voltage source connected to the second driver.

2. The plasma display apparatus of claim 1, wherein the first driver supplies the ground level voltage during at least one of a time interval between after the supply of the positive polarity sustain signal and before the supply of the negative polarity sustain signal or a time interval between after the supply of the negative polarity sustain signal and before the supply of the positive polarity sustain signal.

3. The plasma display apparatus of claim 2, wherein a supply period of the ground level voltage lies substantially in a range between 1 ns and 20 μs.

4. The plasma display apparatus of claim 1, wherein the first driver supplies a first negative polarity sustain signal and then a first positive polarity sustain signal, and a supply period of the ground level voltage during a time interval between after the supply of the first negative polarity sustain signal and before the supply of the first positive polarity sustain signal is long enough to include a predetermined number of sustain signals.

5. The plasma display apparatus of claim 1, wherein the first driver supplies a first negative polarity sustain signal and then a first positive polarity sustain signal, and the first driver supplies a second negative polarity sustain signal and then a second positive polarity sustain signal, the ground level voltage is supplied during a first supply period before the supply of the first positive polarity sustain signal and during a second supply period before the supply of the second positive polarity sustain signal, and a time length of the first supply period is different from a time length of the second supply period.

6. The plasma display apparatus of claim 1, wherein a rising slope of the positive polarity sustain signal is different from a rising slope of the negative polarity sustain signal, or a falling slope of the positive polarity sustain signal is different from a falling slope of the negative polarity sustain signal.

7. The plasma display apparatus of claim 6, wherein an absolute value of the rising slope of the positive polarity sustain signal is larger than an absolute value of the rising slope of the negative polarity sustain signal.

8. The plasma display apparatus of claim 6, wherein an absolute value of the falling slope of the positive polarity sustain signal is smaller than an absolute value of the falling slope of the negative polarity sustain signal.

9. The plasma display apparatus of claim 1, wherein the two first electrodes are successively positioned, and the two second electrodes are successively positioned, and an absolute value of a rising slope of the positive polarity sustain signal is smaller than an absolute value of a falling slope of the negative polarity sustain signal.

10. The plasma display apparatus of claim 1, wherein the reference separation controller is turned off during the supply of the positive polarity sustain signal to the first electrode so that the first reference voltage source is separated from the second reference voltage source.

11. The plasma display apparatus of claim 10, wherein the reference separation controller is turned on during the remaining period except the supply period of the positive polarity sustain signal from the sustain period so that the first reference voltage source is connected to the second reference voltage source.

12. The plasma display apparatus of claim 10, wherein the reference separation controller is turned off during the remaining period except the supply period of the positive polarity sustain signal from the sustain period so that the first reference voltage source is separated from the second reference voltage source.

13. A method of driving a plasma display apparatus including a plasma display panel including first electrodes, second electrodes, and third electrodes, a first driver driving the first electrodes, a second driver driving the third electrodes, a first reference voltage source commonly connected to the first driver and the second electrodes, and a second reference voltage source connected to the second driver, the method comprising:

supplying sustain signals each including a positive polarity sustain signal and a negative polarity sustain signal to the first electrodes during a sustain period, supplying a ground level voltage during at least one time interval between the positive polarity sustain signals and the negative polarity sustain signals; and separating the first reference voltage source from the second reference voltage source during the supply of the positive polarity sustain signal to the first electrode.

14. The method of claim 13, further comprising connecting the first reference voltage source to the second reference voltage source during the remaining period except the supply period of the positive polarity sustain signal from the sustain period.

15. The method of claim 13, further comprising separating the first reference voltage source from the second reference voltage source during the remaining period except the supply period of the positive polarity sustain signal from the sustain period.

16. The method of claim 13, wherein supplying the ground level voltage is performed during at least one of a time interval between after the supply of the positive polarity sustain signal and before the supply of the negative polarity sustain signal or a time interval between after the supply of the negative polarity sustain signal and before the supply of the positive polarity sustain signal.

17. The method of claim 16, wherein a supply period of the ground level voltage lies substantially in a range between 1 ns and 20 μs.

18. The method of claim 13, wherein supplying the sustain signal includes supplying a first negative polarity sustain signal and then supplying a first positive polarity sustain signal, and a supply period of the ground level voltage during a time interval between after the supply of the first negative polarity sustain signal and before the supply of the first positive polarity sustain signal is long enough to include a predetermined number of sustain signals.

19. The method of claim 13, wherein supplying the sustain signal includes supplying a first negative polarity sustain signal and then supplying a first positive polarity sustain signal, and supplying the sustain signal includes supplying a second negative polarity sustain signal and then supplying a second positive polarity sustain signal, the ground level voltage is supplied during a first supply period before the supply of the first positive polarity sustain signal and during a second supply period before the supply of the second positive polarity sustain signal, and a time length of the first supply period is different from a time length of the second supply period.

20. The method of claim 13, wherein a rising slope of the positive polarity sustain signal is different from a rising slope of the negative polarity sustain signal, or a falling slope of the positive polarity sustain signal is different from a falling slope of the negative polarity sustain signal.

21. The method of claim 20, wherein an absolute value of the rising slope of the positive polarity sustain signal is larger than an absolute value of the rising slope of the negative polarity sustain signal.

22. The method of claim 20, wherein an absolute value of the falling slope of the positive polarity sustain signal is smaller than an absolute value of the falling slope of the negative polarity sustain signal.

23. The method of claim 13, wherein the two first electrodes are successively positioned, and the two second electrodes are successively positioned, and an absolute value of a rising slope of the positive polarity sustain signal is smaller than an absolute value of a falling slope of the negative polarity sustain signal.

* * * * *